United States Patent [19]

Cross, III et al.

[11] 4,367,600

[45] Jan. 11, 1983

[54] GOLF SHOE WITH IMPROVED TRANSVERSE TRACTION

[75] Inventors: Henry D. Cross, III, Colt's Neck, N.J.; Charles C. Eaton, Jr.; John Larsen, both of Hingham, Mass.; Rob R. McGregor, Concord, Mass.

[73] Assignee: Colgate-Palmolive Company, New York, N.Y.

[21] Appl. No.: 153,581

[22] Filed: May 27, 1980

[51] Int. Cl.[3] ..... A43B 5/00; A43D 9/00

[52] U.S. Cl. ..... 36/127; 12/142 P

[58] Field of Search ..... 36/127, 129, 59 R, 67; 12/142 R, 142 P

[56] References Cited

U.S. PATENT DOCUMENTS

| | | | |
|---|---|---|---|
| 3,311,999 | 4/1967 | MacNeill | 36/127 |
| 3,732,634 | 5/1973 | Jacobson | 36/127 |
| 4,149,324 | 4/1979 | Lesser et al. | 36/127 |
| 4,180,924 | 1/1980 | Subotnick | 36/127 |

*Primary Examiner*—Patrick D. Lawson

*Attorney, Agent, or Firm*—LeBlanc, Nolan, Shur & Nies

[57] ABSTRACT

A golf shoe having improved transverse ground traction provided by a novel spike pattern which differs between the right-foot and the left-foot shoes in which the spikes are affixed to the lowermost surface of a specially designed sole and heel assembly. Improved comfort and foot stability can also be provided by use of a cushion pad insert of special configuration having a lateral arch support associated therewith. A first set of ground engaging spikes are arranged adjacent to the leading edges of both the right and the left shoe and at least two spikes in the set are positioned in the instep region of the shoes. A second set of spikes is also provided on the trailing edge of the shoes as defined by the direction of a golf club swing.

26 Claims, 6 Drawing Figures

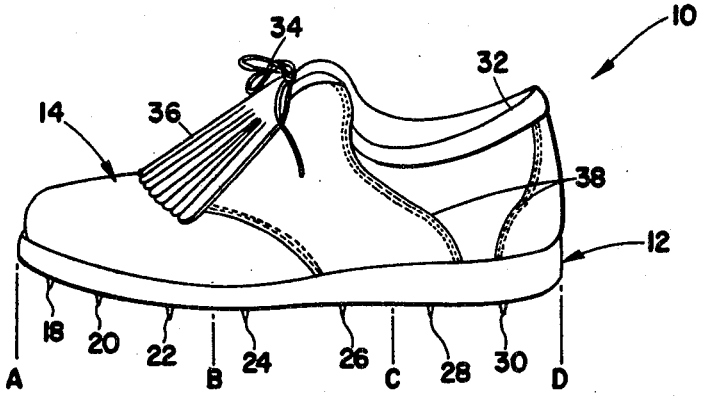
Fig. 1
Fig. 2
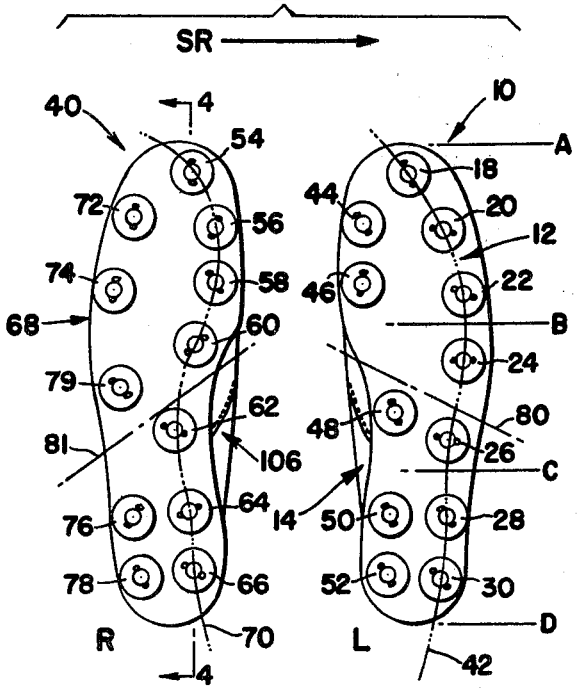
Fig. 3
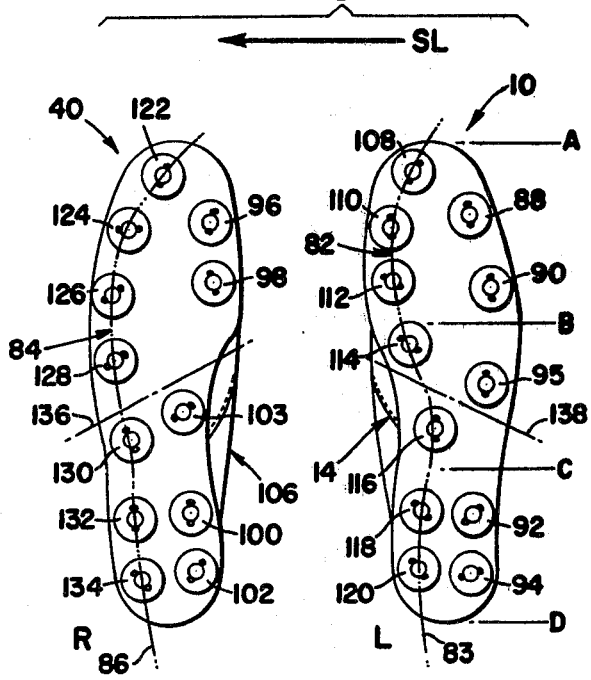

GOLF SHOE WITH IMPROVED TRANSVERSE TRACTION

BACKGROUND OF THE INVENTION

The present invention relates to a golf shoe having improved transverse ground traction provided for by a novel spike pattern and a novel sole and heel assembly. Also, improved comfort and foot stability for the user of the shoe can be provided by use of a cushion pad insert of improved configuration.

Golf shoes have usually been manufactured by placing spikes on the bottom surfaces on otherwise normal sports shoes. Some manufacturers also use metal retainer plates for providing better anchoring for the spikes. It has generally been believed that these spikes could be placed on the bottom of the shoes in any of a variety of uniform patterns for the purpose of increasing ground traction. It is also known that various cushion pads for shoes are usable and in fact desirable for some persons.

In the manufacturing of jogging and running shoes, various sole designs and heel designs have been employed in order to better distribute the weight of the runner with respect to the predominantly linear forces set up in the direction of motion and vertically through the legs.

It has been discovered that the transverse forces generated during the swinging of golf clubs by a number of golfers of different ability levels or handicaps are not uniform with respect to the entire bottom plane of the shoes and that these transverse forces differ between the right and left shoe, and that the forces are subject to considerable change during a completed golf swing. Upon analysis of the forces developed during various phases of a golf swing it was discovered that a novel arrangement of the spikes provides ground traction having optimum stabilizing effects. The placement of spikes in the unique pattern developed departs markedly from spike patterns which have been used for shoes being used for predominantly linear forward motion.

The position and pattern of both shear and vertical forces developed during a golf swing were determined and found to be important factors influencing user stability and ground traction. The spike placement in the right shoe is different from that in the left shoe to accommodate the markedly different ground reaction forces developed by the right and left golf shoes during a golf swing.

SUMMARY OF THE INVENTION

The present invention provides a golf shoe having improved transverse ground traction. The improvement is obtained by positioning the spike pattern on the right foot and the left foot shoes differently to reflect the ground reaction forces and center of pressure patterns generated during the golf swing. In addition, improved transverse traction is also obtained by a specially designed sole and heel assembly for use in conjunction with the spike pattern.

Also, an improved cushion pad can be employed for cradling the users feet for better cooperation with the sole and heel assembly having the unique spike pattern thereon.

BRIEF DESCRIPTION OF THE DRAWINGS

FIG. 1 is a side perspective view of the golf shoe of the present invention;

FIG. 2 is a bottom view of a pair of golf shoes showing the pattern of the spikes for a right-handed golf club swing as defined by the direction of the arrow "SR";

FIG. 3 is a bottom plan view of a pair of golf shoes showing the pattern of the spikes for a left-handed golf club swing as defined by the direction of the arrow "SL";

DESCRIPTION OF THE PREFERRED EMBODIMENTS

Figure 4:
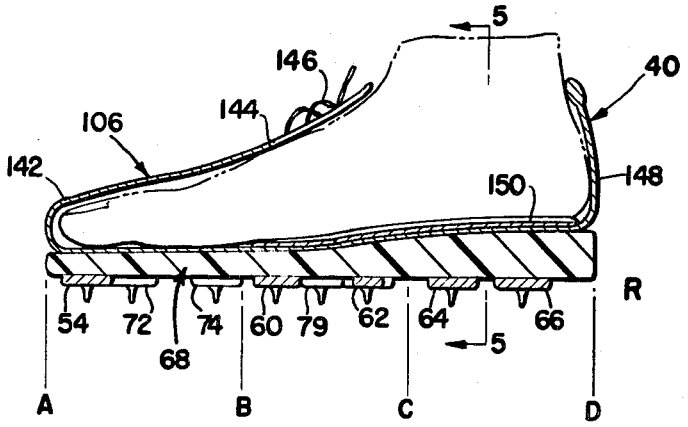
FIG. 4 is a cross-sectional side elevation view of the right-foot golf shoe illustrated in FIG. 2 taken on the line 4—4.

Referring to FIG. 1, the golf shoe of the present invention 10 is shown with a sole and heel assembly 12 connected to a flexible leather upper 14. The left-foot shoe illustrated shows seven spikes viewable along the left edge of the sole and heel assembly 12. Three of these spikes 18, 20, and 22, are located in the toe-portion of the sole and heel assembly which underlie the phalanges bones of the toe and which is identified by the area between lines A and B. Another two of the spikes are positioned in the instep region B-C which underlies the metatarsal bones of the foot. These two spikes 24 and 26 are attached to the lowermost surfaces of the sole and heel assembly 12. The lower surface of the instep region B-C is formed in a continuous plane with the lowermost surfaces of the sole region A-B and the heel region C-D of the assembly 12. If a conventional sole and protruding heel assembly were employed, the spikes 24 and, particularly, 26 would not have the support surface available by the sole and heel assembly 12 as shown.

Two additional spikes 28 and 30 are positioned in the heel region of assembly 12 underlying the tarsal and the calcaneus bones of the foot.

Golf shoe 19 is formed with the upper 14 thereof constructed of pliable leather, although leather-substitute, canvas or nylon materials could also be employed for this purpose. Shoe upper 14 is formed with a tubular ankle contacting edge 32, lacing 34 and a lace cover 36. Conventional stitching 38 is also used.

Referring now to FIGS. 2–5, the unique spike pattern of the present invention is shown by bottom plane view of the left-foot shoe 10 and the right-foot shoe 40 of the golf shoe pair illustrated. The seven spikes 18–30 of the left-foot shoe 10 are arranged along a curved path parallel to and adjacent to the outer edge of the sole and heel assembly 12. The spikes arranged along the curved path 42 form a first set of ground engaging spikes which are affixed to the lowermost surface of the assembly 12. A second set of spikes is provided by spikes 44, 46, 48, 50 and 52 which are arranged in a pattern of two pairs and one single. A first pair is located in the inside toe region and a second pair is located in the heel region on the inside area of the sole and heel assembly 12 while the single spike 48 is located in the instep region B-C.

The right-foot shoe 40 has a first set of ground engaging spikes constituted by spikes 54, 56, 58, 60, 62, 64, and 66 which are affixed to the lowermost surface of the right-foot sole and heel assembly 68 along a curved path 70. Path 70 is spaced adjacent to and generally parallel to the inside edge of the sole and heel assembly 68. A second set of spikes is attached to the lowermost surface of assembly 68 and constitutes a first pair 72 and 74 located in the toe-region A-B toward the outer edge. A second pair of spikes 76 and 78 in this second set is located in the heel region C-D toward the outside edge and a single spike 79 is positioned in the instep region B-C.

The design of the spike patterns on left-foot shoe 10 (marked "L") and the right-foot shoe 40 (marked "R") is controlled by the direction of swing indicated by arrow "SR" at the top of the figure. The golf club swing indicated is that for a right-handed golfer in which the left shoe 10 is the leading shoe and the right shoe 40 is the trailing shoe. It can be seen that the curved paths 42 and 70 are located along the leading edges of the two shoes 10 and 40.

It has been discovered that it is the leading edges of the golf shoes which require the ground engaging frictional traction in order to offset the large lateral forces which exists between the sole and heel assemblies 12 and 68 and the ground during a golf club swing. Also, it has been found particularly important to position spikes in the instep area B-C of the golf shoes which generally underlies the metatarsal bones of the feet. This has been provided by spikes 24, 26, and 48 on the left-foot shoe 10 and spikes 60, 62 and 79 on the right-foot shoe 40. The lateral forces patterns tend to concentrate in this instep area during the swing motion. Consequently, an embodiment of the present invention is to place two or more spikes in the instep area B-C or preferably three as described. The three spikes affixed on the lowermost surface of the sole and heel assemblies 12 and 68 of the two shoes 10 and 40, respectively, in the instep regions B-C are particularly positioned with respect to the lines of flexure of these assemblies. The left shoe 10 has two of these spikes 26 and 48 positioned on the heel side of flexure line 80 and a single spike 24 located on the toe side of the line of flexing. The right shoe 40 has two of the spikes 60 and 79 positioned on the toe side of the flexure line 81 and a single spike 62 positioned on the heel side of the line. For each of the shoes two of the spikes are positioned in the first spike set arranged along the curved path adjacent to the leading edges and the third spike is positioned adjacent to the trailing edges of each of the shoes in the instep region B-C and forms part of the second set of spikes. These positioning patterns are specified by: (A) the leading shoe as defined by a golf club swing having two of three spikes in the instep region placed to the heel side of the flexure line, and (B) the trailing shoe as defined by a golf club swing having two of three spikes in the instep region placed to the toe side of the flexure line. When the two spike pattern is used in the instep region B-C the spikes are arranged on the curved paths 42 and 70 of the first spike set, hence for this pattern the second spike set consists of only four spikes arranged in two pairs. Another variation is that a minimum of six spikes can be arranged along the curved paths 42 and 70, particularly, for golfers of low weight.

The second set of spikes represented by the five spikes on each of the shoes on the trailing edges thereof are positioned to give a better balancing of the ground engaging traction for the complete spike sets. It should also be appreciated that the spike patterns shown in FIG. 2 are not those which are best for a walking shoe since the traction is unevenly distributed across the lowermost surfaces of the shoes. Hence, the spike patterns of the present invention are specific to improved ground contacting frictional engagement during a lateral motion such as that required for swinging a golf club.

A golf club swing has three phases: (A) the power stroke, (B) the impact, and (C) the follow-through. On the power stroke phase, the spikes arranged along the curved path 70 on the right-foot shoe 40 provide ground engaging traction. As the stroke passing through the impact phase and into the follow-through phase, the dominant frictional forces between the lowermost surfaces of the shoes and the ground shift to the left foot and the spikes located along the curved path 42 of shoe 10 then provide needed frictional traction for the leading show which has a tendency to lift up and away from the ground. The positioning of the curved paths 42 and 70 laterally between the edges of the shoes 10 and 40 is controlled by the findings of the above referred to kinetic and kinematic studies.

Referring now specifically to FIG. 3, the spike patterns for a left hand golf club swing are illustrated using the same positioning of the left shoe 10 and the right shoe 40 as shown in FIG. 2. The direction of the club swing is shown by the upper arrow "SL". On the left shoe 10, the first set of spikes 82 is positioned along the curved path 83 and the first set of spikes 84 on the right shoe 40 are positioned along curved path 86. Curved paths 83 and 86 are located parallel to and adjacent to the leading edges of the two golf shoes. This positioning is a mirror image of the spike placement patterns employed for a right-handed golf swing as illustrated is FIG. 2. As in FIG. 2, a second set of spikes is distributed on the trailing edges of shoe 10 and is constituted by a first pair of spikes 88 and 90 located in the toe region A-B, a second pair 92 and 94 located in the heel region C-D of assembly 12, and a single spike 95 positioned in instep region B-C. In a like manner, a second set of spikes is formed by the first pair 96 and 98 on the left shoe 40. The second set of spikes is completed by a second spike pair 100 and 102 located in the heel region and a single spike 103 positioned in the instep region B-C.

The right shoe upper 106 and a left shoe upper 14 can also be seen in FIG. 3. As in FIG. 2, there are seven spikes 108, 110, 112, 114, 116, 118 and 120 in the first spike set located along the curved path 83 and seven spikes 122, 124, 126, 128, 130, 132, and 134 located along path 86 and these are positioned in the same leading edge and longitudinal relationships with respect to the toe region A-B underlying the phalanges of the toe and the instep region B-C underlying the metatarsal bones and the heel region C-D.

The five spikes in each of the second sets of spikes are arranged in the toe, inset, and heel regions in a pair-single-pair pattern along the trailing edges of the two shoes. The three spikes in the instep region B-C are also arranged so that two of spikes on the leading shoe 40 are positioned to the heel side of flexure line 136 and the third spike is to the toe side of the line.

Two of the three spikes on the trailing shoe 10 in the instep region B-C are located above the flexure line 138.

Referring now to FIG. 4, a cross-sectional view of the right-foot shoe 40 of FIG. 2 is shown which cuts through four of the spikes located along curved path 70. The golf shoe 40 is composed of the sole and heel assembly 68 which is integrally joined to a flexible, upper 106 which is made from a soft leather, canvas, or like material. The upper is constructed of a toe portion 142, a lace region 144 having laces 146 therein and a heel portion 148. Underlying the foot of the user is a lateral arch support 150 which is also described in FIGS. 5 and 6.

The four spikes intersected by the cross-sectional line 4—4 are seen as spikes 54, 60, 64 and 66. The remaining spikes 72, 74, 79 and 62 are not intersected by the sectioning line. The placement of the three spikes, 54, 72 and 74 are in the toe region A-B of the assembly 68 which immediately underlies phalanges of the toe. The three spikes 60, 79 and 62 are located in the instep region B-C of assembly 68 immediately underlying the metatarsal bones in the foot. The heel region spikes 64 and 66 are then located immediately below the tarsal and calcaneus bones of the foot. It can be seen in FIG. 4 that the sole and heel assembly 68 has a continuous lowermost plane to which the spikes are integrally attached. Further, the increase in thickness from the toe region to the heel region in the assembly 68 occurs mainly in the instep region between lines B and C.

Figure 5:
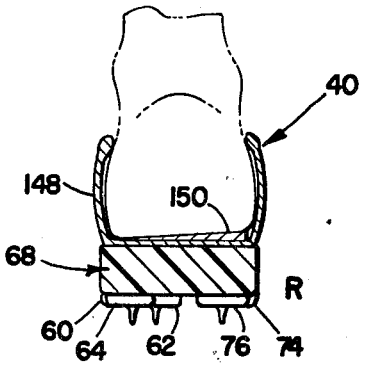
FIG. 5 is a cross-sectional view of the golf shoe illustrated in FIG. 4 taken along line 5—5.

FIG. 5 shows a cross-section of shoe 40 taken on line 5—5 in FIG. 4 in which the wedge shape of lateral arch support 150 can be seen. This arch support extends from the instep region through the heel region to encompass that portion of assembly 68 between lines B and D. The transverse shape of the lateral arch support 150 is shown in FIG. 5 wherein the greatest thickness is to the outside of the shoe 40 which is the shoe for a right-handed person. Hence, the lateral arch support 150 tilts the ankle of the user inwardly.

The lateral arch support 150 can be of the relatively planar configuration as illustrated in FIGS. 4 and 5 or it can be formed as the lowermost portion of a cushion pad insert wherein a lower arcuate wall extends upwardly away from the arch support in the heel area and is surrounded by the heel portion 148 of the shoe and which then diminishes in vertical height as it connects to the forward most portions of the support which are located in the instep region. A cushion pad insert for a sports shoe fabricated from a closed pore form of cross-linked ethylene vinyl acetate- low density polyethylene copolymer is described in the copending application entitled CUSHION PAD FOR SPORT SHOE AND THE LIKE AND METHOD FOR FABRICATING SAME, U.S. Pat. application Ser. No. 91,706 by John Larsen and Rob Roy McGregor and assigned to the assignee of the present application.

Figure 6:
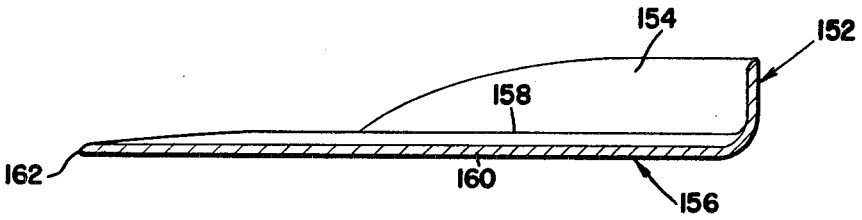
FIG. 6 is a cross-sectional view of a combined lateral arch support and a cushion pad insert for the golf shoes.

FIG. 6 shows lateral arch support 152 in a similar cross-sectional view to that shown in FIG. 4 in a cushion pad form wherein an arcuate wall 154 is provided around the heel portion which extends upwardly away from the support member 156 and forward into the instep region and diminishes in vertical height to merge with the support member 156. The wedge shape of lateral arch support 152 can be seen from the outer thick portion 158 compared to the cross sectional thickness 160. These two thicknesses taper to a common frontal edge 162 which is located just in back of the first metatarsal joint of the foot.

Also, if desired, the cushion pad insert illustrated in FIG. 6 can be employed in a form such as described and claimed in U.S. Pat. application Ser. No. 91,706 wherein the lowermost plane has a uniform cross section and hence does not function to tilt the user's ankle inwardly. That is, the cushion pad insert disclosed and claimed in the copending application can be employed with the golf shoe described and claimed in the present application without modification.

The purpose of the shoe cushion illustrated in FIG. 6 is to provide controlled cradling of the heel of the foot and to position the foot better with respect to cooperation with the spike pattern on the shoes 10 and 40. If desired, the cushion pad can be formed to extend along the entire undersurface of the users foot. This cushion pad provides support for the soft tissue particularly in the calcaneus region of the foot. The polymeric material employed can conform to the shape of the different users feet since the material can be made to have varying degrees of compressibility.

The golf shoes 10 and 40 are fabricated by forming a spike retainer member in a shape compatible with the sole and heel assembly and securing the spikes thereto in the above described pattern and then joining this spike structure to a preformed shoe upper by the unitary molding of the sole and heel assembly. This assembly is formed from a molded pore-formed polymeric material such as polyurethane or cushion crepe rubber. The ground engaging spikes are usually constructed of metal and can be secured to the retainer member in order to provide slightly modified patterns as set forth above. The retainer member can be formed from either metal or a polymeric material.

The various alternative modifications described can be made to either of the shoes of a pair with out modification of the other shoe, if desired.

The invention may be embodied in other specific forms without departing from the spirit or essential characteristics thereof. The present embodiments are therefore to be considered in all respects as illustrated and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a pair of golf shoes having sole and heel assemblies integrally attached to flexible shoe uppers; the improvement comprising:

a continuous ground contacting plane formed by the lowermost surfaces of said sole and heel assemblies over the entire area thereof, each of said pair of shoes having a first and a second set of ground engaging spikes affixed to the lowermost surfaces of said assemblies, said first set of spikes attached along curved paths spaced adjacent to the leading side edges of each of said pair of assemblies as defined by the direction of a golf club swing, said paths extending from the central toe position of said shoes through the heel positions and having at least two spikes positioned in the instep region of said shoes along each of said paths, said second set of ground engaging spikes affixed to the lowermost surface of said assemblies along the trailing edge of said shoes in the toe region and in the heel region, said first set of spikes providing ground engaging frictional traction along the entire leading edges of said pair of shoes to anchor said shoes against lateral forces between said shoes and the ground during a golf club swing.

2. In a trailing golf shoe as defined by the direction of a club swing, said shoe having a sole and heel assembly integrally attached to a flexible shoe upper; the improvement comprising:

a continuous ground contacting plane formed by the lowermost surface of said sole and heel assembly over the entire area thereof, a first set of ground engaging spikes affixed to the lowermost surface of said assembly along a curved path spaced adjacent to the leading edge of said assembly; said path extending from a central toe position through the heel position and having at least two spikes positioned in the instep region of said shoe; and a second set of ground engaging spikes affixed to said assembly in the toe region and in the heel region of said trailing shoe, said first set of spikes providing ground engaging frictional traction along the entire leading edge of said shoe to anchor the same against lateral forces between said shoe and the ground during the powered portion of a golf club swing.

3. In a leading golf shoe as defined by the direction of a club swing, said shoe having a sole and heel assembly integrally attached to a flexible shoe upper; the improvement comprising:

a continuous ground contacting plane formed by the lowermost surface of said sole and heel assembly over the entire area thereof, a first set of ground engaging spikes affixed to the lowermost surface of said assembly along a curved path spaced adjacent to the leading edge of said assembly, said path extending from a central toe position through the heel position and having at least two spikes positioned in the instep region of said shoe, and a second set of ground engaging spikes affixed to said assembly in the toe region and in the heel region of said leading shoe, said first set of spikes providing ground engaging frictional traction along the entire leading edge of said shoe to anchor the same against lateral forces between said shoe and the ground during the follow-through portion of a golf club swing.

4. The improvement according to claims 1, 2 or 3, wherein said first set of ground engaging spikes has a greater number of spikes therein than said second set of spikes.

5. The improvement according to claims 1, 2 or 3, wherein said second set of spikes includes a spike positioned in the instep.

6. The improvement according to claims 1, 2 or 3, wherein said sole and heel assemblies have heel portions of greater height than the sole portions and wherein said assemblies are of uniform thickness in transverse planes taken across the width thereof.

7. The improvement according to claims 1, 2 or 3, wherein said first and said second set of ground engaging spikes are affixed to a retainer member which is integrally molded within said sole and heel assemblies.

8. The improvement according to claim 5, wherein a lateral arch support is positioned in said shoe in the heel and instep regions and wherein said arch support tilts the users ankle inwardly.

9. The improvement according to claims 1, 2 or 3, wherein said shoes have therein a removable pore-formed polymeric material cushion pad extending from said heel area to at least the area overlying the instep region of said sole and heel assembly for providing cradling support of users feet.

10. The improvement according to claim 9, wherein a removable lateral arch support is positioned between said sole and heel assembly and said cushion pad in the leading shoe.

11. The improvement according to claim 8, wherein said lateral arch support extends along the entire length of the users foot from the toe position to the heel position.

12. The improvement according to claim 9, wherein said cushion pad has an integrally molded lateral arch support portion formed therein for tilting the users ankle inward.

13. The improvement according to claims 2 or 3, wherein said shoes have therein a removable cushion pad having a thickness along the trailing edge of the shoe greater than the thickness along the leading edge thereof as defined by the direction of a golf club swing.

14. The improvement according to claims 1, 2 or 3, wherein said spikes are placed substantially equidistant along said curved paths.

15. The improvement according to claims 1, 2 or 3, wherein said sole and heel assemblies are formed from cushion crepe rubber or a pore-formed polyurethane.

16. The improvement according to claims 1, 2 or 3, wherein said sole and heel assemblies are wedge-shaped with the heel portion of greater thickness than the toe portion, and wherein the majority of the increase in thickness from the toe position to the heel position occurs along the length of the instep region of said assemblies.

17. The improvement according to claims 1, 2 or 3, wherein said flexible shoe upper is formed from pliable leather.

18. A method of making a golf shoe having increased transverse ground traction during a golf club swing comprising the steps of:

forming a spike retainer member in a shape compatible with a shoe sole and heel assembly, securing a first set of ground engaging spikes to the undersurface of the retainer member along a curved path to be spaced adjacent to the leading edge of the sole and heel assembly as defined by the direction of a club swing, laying out the path of spike placement to extend from a central toe position through the heel position and having at least two spikes positioned in the instep region of the shoe, securing a second set of ground engaging spikes to said retainer member in the toe area, the instep region, and in the heel area of the shoe including the positioning of a spike in the instep region of the sole and heel assembly, and joining a flexible shoe upper structure to the spike retainer member by a unitary molding of a pore-formed polymeric material to complete the sole and heel assembly with a continuous ground contacting plane formed by the lowermost surface of the pore-formed polymeric material.

19. The method according to claim 18, wherein said securing of the first set of spikes to the retainer member is carried out by securing at least six spikes along the curved path.

20. The method according to claim 18, wherein said pore-formed polymeric material is a polyurethane.

21. The method according to claim 18, wherein said pore-formed polymeric material is a crepe rubber.

22. A method according to claim 18, wherein the securing of said second set of spikes is carried out by securing at least four spikes to the retainer member.

23. In a sport shoe of the type comprising an upper that opens to internal heel and sole regions spaced by an instep region and a lateral arch support cushion wedge member mounted within the shoe to substantially overlie at least said heel region, said member being thickest at the side which underlies the outer side of the foot of the wearer and tapering in thickness laterally toward the inner side of the foot of the wearer whereby to effectively and comfortably tilt the wearer's foot and direct the wearer's weight toward the inner side thereof.

24. In the shoe defined in claim 23, said lateral arch support cushion member having a portion that tapers in thickness toward the instep region and that extends to overlie at least that part of the instep region that underlies the outer side of the instep of the foot of the wearer.

25. In the shoe defined in claim 23, said lateral arch support cushion wedge member being an integral synthetic plastics element surface bonded to said heel region.

26. A lateral arch support cushion wedge member adapted to extend over heel and instep regions of a sport shoe, said member being an integral synthetics plastic element that is thickest along one side edge and tapers laterally toward a thin edge along the other side, and tapers longitudinally toward a thin frontal edge adapted to lie in said instep region of the shoe.

* * * * *